US010294680B2

(12) United States Patent
Steger

(10) Patent No.: US 10,294,680 B2
(45) Date of Patent: May 21, 2019

(54) MASONRY WALL COVER

(71) Applicant: Nathan Charles Steger, Ridgway, PA (US)

(72) Inventor: Nathan Charles Steger, Ridgway, PA (US)

( * ) Notice: Subject to any disclaimer, the term of this patent is extended or adjusted under 35 U.S.C. 154(b) by 0 days.

(21) Appl. No.: 15/043,062

(22) Filed: Feb. 12, 2016

(65) Prior Publication Data

US 2016/0244987 A1 Aug. 25, 2016

Related U.S. Application Data

(60) Provisional application No. 62/116,110, filed on Feb. 13, 2015.

(51) Int. Cl.
*E04G 21/24* (2006.01)
*E04G 21/28* (2006.01)

(52) U.S. Cl.
CPC ..... *E04G 21/245* (2013.01); *E04G 21/28* (2013.01); *E04G 21/24* (2013.01); *E04G 21/246* (2013.01)

(58) Field of Classification Search
CPC ..... E04G 21/245; E04G 21/24; E04G 21/28; E04G 21/246
USPC ..... 52/3, 105, 300, DIG. 12
See application file for complete search history.

(56) References Cited

U.S. PATENT DOCUMENTS 2,232,905 A * 2/1941 Dyer ..... E04D 3/405 52/300
3,416,282 A * 12/1968 Daugherty ..... A47B 95/04 428/122
3,802,140 A * 4/1974 Hickman ..... E04D 3/405 52/300
4,443,508 A * 4/1984 Mehl ..... B60J 10/16 16/86 A
4,768,320 A * 9/1988 Weller ..... E04G 21/30 52/211
5,289,662 A * 3/1994 Castle ..... E04D 3/405 52/287.1

(Continued)

FOREIGN PATENT DOCUMENTS

CA 2436074 A1 * 9/2002 ..... E04D 3/405
DE 102008060129 A1 * 6/2010 ..... E04D 21/28

(Continued)

OTHER PUBLICATIONS

Harrer Josef, Machine_translate_DE102011011306, 2012-08-2016, retrived translation from EPO Website on Aug. 17, 2016. (http://translationportal.epo.org/emtp/translate/?ACTION=description-retrieval&COUNTRY=DE&ENGINE=google&FORMAT=docdb&KIND=A1&LOCALE=en_EP&NUMBER=102011011306&OPS=ops.epo.org/3.1&SRCLANG=de&TRGLANG=en).*

*Primary Examiner* — Babajide A Demuren
(74) *Attorney, Agent, or Firm* — Duane Morris LLP; J. Rodman Steele, Jr.; Gregory M. Lefkowitz

(57) ABSTRACT

A bracket having a generally U-shape is disclosed. The bracket is sized and configured to be received over a wall, such as, for example, a masonry wall, to maintain a wall covering thereon. The bracket comprises a first leg and a second leg coupled by a cross-member to define the generally U-shape. The legs may be angled such that the spaced between the legs at the open end of the U-shape is smaller than the space between the legs at the cross-member. The bracket may also be provided as part of a kit. The kit includes at least one bracket and instructions. A method of covering a wall with a bracket is also disclosed.

16 Claims, 8 Drawing Sheets

(56) References Cited

U.S. PATENT DOCUMENTS

| | | | | | |
|---|---|---|---|---|---|
| 5,479,750 | A * | 1/1996 | Carlberg | E04B 5/12 | 428/192 |
| 5,592,785 | A * | 1/1997 | Gavin | E02D 29/12 | 16/444 |
| 5,772,185 | A * | 6/1998 | Pulsipher | E04D 3/405 | 256/1 |
| 6,270,399 | B2 * | 8/2001 | Gunn | B27G 17/025 | 451/524 |
| 6,796,049 | B1 * | 9/2004 | Claxton | E04F 21/0092 | 33/527 |
| 7,353,640 | B2 * | 4/2008 | Stutler | E04D 3/405 | 52/100 |
| 7,461,461 | B2 * | 12/2008 | Howell | E04G 21/18 | 33/404 |
| 8,613,163 | B2 * | 12/2013 | Smith | F16B 2/12 | 269/143 |
| 2003/0079437 | A1 * | 5/2003 | Near | E04G 21/1841 | 52/749.13 |
| 2004/0079039 | A1 * | 4/2004 | Shaw | E04B 5/12 | 52/300 |
| 2012/0272587 | A1 * | 11/2012 | Papierowski | E06B 5/16 | 52/105 |
| 2013/0025238 | A1 * | 1/2013 | Lee | E04C 3/125 | 52/835 |
| 2013/0291464 | A1 * | 11/2013 | Resso | E04D 3/405 | 52/300 |

FOREIGN PATENT DOCUMENTS

| | | | | |
|---|---|---|---|---|
| DE | 202011002768 | U1 * | 5/2012 | E04G 21/245 |
| DE | 102011011306 | A1 * | 8/2012 | E40G 21/28 |
| DE | 102013103385 | A1 * | 10/2014 | E04G 21/245 |
| GB | 2485658 | A * | 5/2012 | E04G 21/245 |

* cited by examiner

MASONRY WALL COVER

RELATED APPLICATIONS

This application claims priority under 35 U.S.C. § 119(e) to U.S. Application Ser. No. 62/116,110, "Masonry Wall Cover," filed Feb. 13, 2015, which is incorporated herein in its entirety.

FIELD

The present invention relates generally to an apparatus and methods for construction, and particularly, construction of structures including masonry walls.

BACKGROUND

During construction, walls may be exposed to environmental elements, such as moisture, that would not be encountered after construction. For example, in some embodiments, a partially completed wall may be subject to weather and other environmental factors prior to a covering or sealing agent being placed over the wall. In other embodiments, interior walls are subject to environmental factors prior to completion of the outer structure. The walls may be damaged during construction due to environmental effects. For example, the mortar joining a masonry wall may be weakened and/or dislodged by moisture prior to completion of the masonry wall.

SUMMARY

In some embodiments, a bracket having a generally U-shape is disclosed. The bracket is sized and configured to be received over a wall, such as, for example, a masonry wall, to maintain a wall covering thereon. The bracket comprises a first leg and a second leg coupled by a cross-member to define the generally U-shape. The legs may be angled such that the spaced between the legs at the open end of the U-shape is smaller than the space between the legs at the cross-member. In some embodiments, the legs comprise gripping features configured to provide a secure coupling between the bracket and the wall in the presence of a wall covering. The legs may also include a tab for flexing the legs outward.

In some embodiments, a method is disclosed. The method includes placing a covering over the wall and coupling the covering to the wall using a bracket as described herein. The bracket may be placed over the covering and the wall to hold the covering against the wall. The length of the cross-member of the bracket may be equal to or greater than a width of the wall. The coupling step can also include flexing one or both legs of the bracket outward before placing the bracket over the covering and the wall. When the legs are released, the legs will move back inward. The method may include selecting a bracket with at least one leg having a length between about ¼ and ¾ of the height of the wall to be covered.

In some embodiments, a kit is disclosed. The kit includes at least one bracket and instructions. The instructions may include using the bracket as part of a wall cover. For example, the instructions may include coupling a covering to the wall using the bracket, wherein the bracket is placed over the covering and the wall to hold the covering against the wall. The instructions may be written instructions describing the position of the bracket during the coupling step. The at least one bracket in the kit may include a plurality of bracket having different sizes. A user may select an appropriately-sized bracket from the plurality. The kit may also include at least one covering.

BRIEF DESCRIPTION OF THE FIGURES

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

In various embodiments, a wall bracket 2 is disclosed. The wall bracket 2 comprises a first longitudinal leg 4*a* and a second longitudinal leg 4*b* coupled by a cross-member 6. The longitudinal legs 4*a*, 4*b* are sized and configured to be placed over a wall, such as, for example, a masonry wall. The legs 4*a*, 4*b* are spaced apart a predetermined distance to secure a cover, such as, for example, a plastic sheet and/or a tarp to the wall. The legs 4*a*, 4*b* of the bracket 2 are biased inwards to apply a force to the cover to maintain the position of the cover on the wall.

Figure 1:
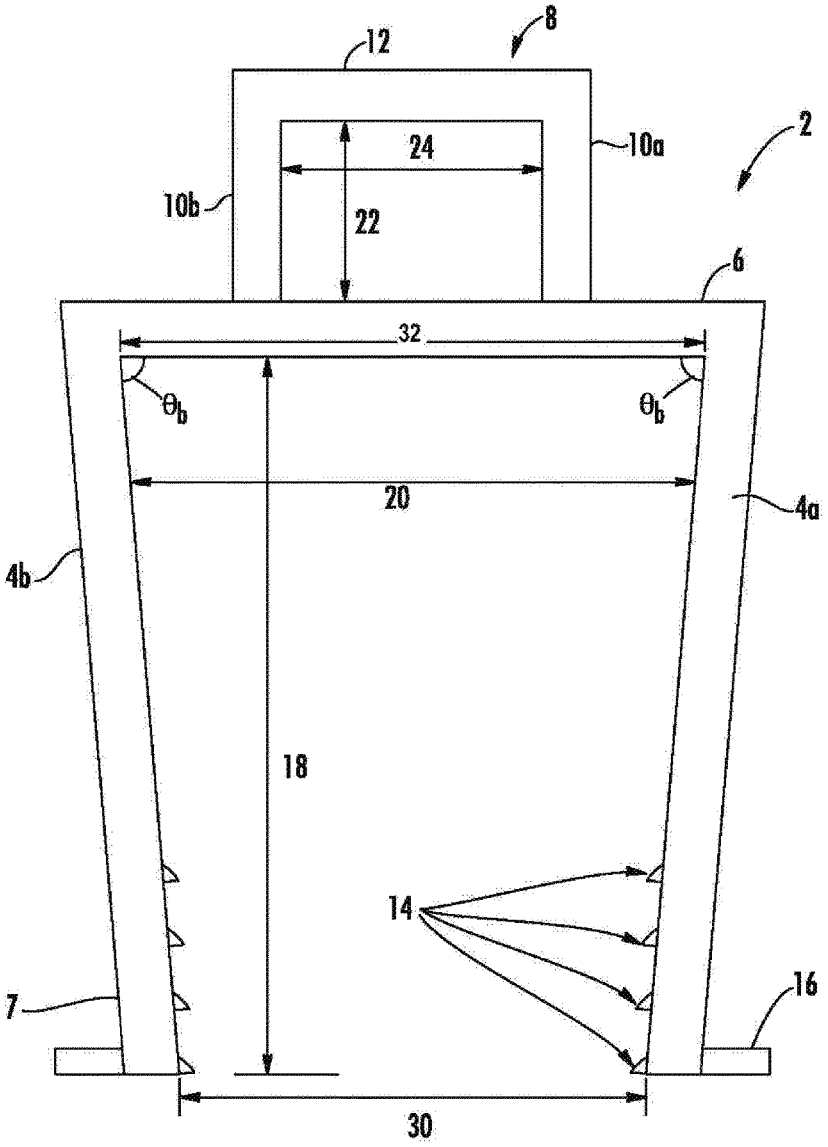
FIG. 1 illustrates a front view of one embodiment of a wall bracket.

FIG. 1 illustrates one embodiment of a wall bracket 2. The bracket 2 is sized and configured to securely hold a covering over a wall, such as, for example, a masonry wall. The bracket 2 comprises a first leg 4*a* and a second leg 4*b* coupled by a cross member 6 at a first end 5. The first leg 4*a*, the second leg 4*b*, and the cross-member 6 define a generally U-shape having an open second end 7. In some embodiments, the first leg 4*a* and/or the second leg 4*b* are angled such that the legs 4*a*, 4*b* define a wider spacing closer to the cross-member 6 and a narrower spacing at the open second end 7. In some embodiments, the space 30 between the legs 4*a*, 4*b* at the second end 7 is selected such that the legs 4*a*, 4*b* are forced apart by the wall and apply an inward force against the wall when the bracket 2 is installed. The space 32 between the legs 4*a*, 4*b* at the cross-member 6 may be sized to fit any suitable wall, such as, for example, a partially constructed, fully constructed, unfinished, partially finished, and/or fully finished wall comprising any suitable building material, including, but not limited to, brick, stone, marble, granite, travertine, limestone, cast stone, concrete (including concrete block and poured concrete), glass block, stucco, cob, wood, veneer, and/or any other suitable construction material. In some embodiments, the brackets 2 are configured to couple a covering to stocked materials located on a storage surface, such as, for example, a scaffolding or the ground.

As shown in FIG. 1, the cross-member 6 can been the legs 4*a*, 4*b* to form an angle. In some embodiments, at least one of the interior angles $\theta_a$, $\theta_b$ between the cross-member 6 and the legs 4*a*, 4*b*, respectively, is less than 90°, or less than 87.5°, or less than 85°, or less than 82.5°, or less than 80°, or less than 77.5°, or less than 75°. In some embodiments, the interior angles $\theta_a$, $\theta_b$ are the same.

In some embodiments, the bracket 2 comprises a handle 8. The handle 8 is sized and configured to allow easy transport, positioning, placement and/or removal of the bracket 2. In some embodiments, the handle 8 comprises a first longitudinal member 10*a*, a second longitudinal member 10*b*, and a horizontal member 12 coupled to a first end of the longitudinal members 10*a*, 10*b*. The first and second longitudinal members 10*a*, 10*b* are coupled to the cross-member 6 at respective second ends. The handle 8 may be located on any suitable location on the cross-member 6, such as, for example, centered on the cross-member 6. In some embodiments, the handle 8 comprises dimensions configured to allow convenient gripping and installation by a user. For example, in some embodiments, the handle may comprise a ¾" thick square having a height 22 of 2" from the cross-member 6 and a width 24 of 4" from the first longitudinal member 10*a* to the second longitudinal member 10*b*. In some embodiments, the opening in the handle is sized and configured to allow a support, such as, for example, a 2×4 stud to be inserted therethrough. In some embodiments, a 2×4 stud may be inserted through the handles of two or more brackets to lock the brackets together, for example, to provide additional resistance for the wall covering on windy days.

In some embodiments, the legs 4*a*, 4*b* of the bracket 2 comprise gripping features 14 configured to securely couple the bracket 2 to the wall. The gripping features 14 may comprise any suitable feature configured to provide a secure coupling to a wall having a covering located between the bracket 2 and the wall. For example, in some embodiments, the gripping features 14 comprise rigid prongs extending from the inner surface of the legs 4*a*, 4*b*. In some embodiments, only one of the legs 4*a*, 4*b* comprises gripping features 14. The legs 4*a*, 4*b* may comprise any number of gripping features 14. When the bracket 2 is installed on the wall, the gripping features 14 are forced into contact with the wall by the angling or inward bias of the legs 4*a*, 4*b*. Although the illustrated gripping features 14 are triangular, it will be recognized that the gripping features 14 may comprise any suitable shape such as, for example, saw-tooth, square, triangular, and/or any other suitable shape.

Figure 4:
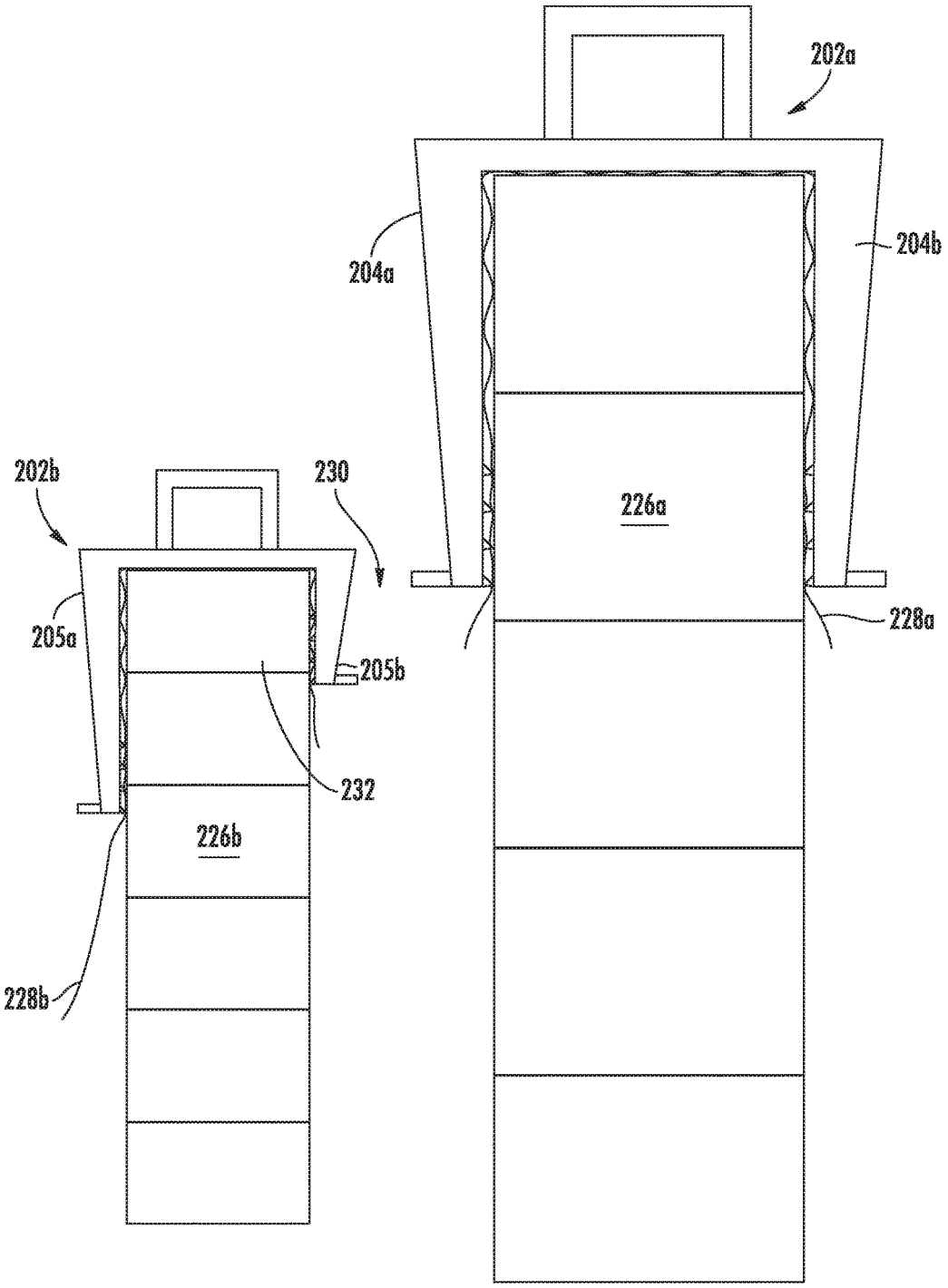
FIG. 4 illustrates a multi-width masonry wall comprising a first section having a first bracket coupled thereto and a second section having a second bracket coupled thereto.

The width 20 between the first and second legs 4*a*, 4*b* is selected based on the width of the wall on which the bracket 2 is to be placed. For example, in various embodiments, the width 20 may comprise any suitable width, such as, for example, about ¾" to about 32". In some embodiments, multiple brackets may be available with varying widths 2 from about ¾" to about 23¾" in 2" increments. The length 18 of the legs 4*a*, 4*b* is selected based on one or more specifications, such as, for example, the height of the wall. For example, in some embodiments, the length 18 is selected such that the legs 4*a*, 4*b* extend between ¼ and ¾ of the height of the wall. Although in the illustrated embodiment the length 18 of the legs 4*a*, 4*b* is the same, as shown in FIG. 4, in some embodiments, the first leg 4*a* comprises a first length and the second leg 4*b* comprises a second length different from the first length. In some embodiments, the first length can be less than 90% of the second length, or less than 80% of the second length, or less the 70% of the second length, or less than 60% of the second length. In some embodiments, the legs 4*a*, 4*b* may comprise any suitable width, such as, for example, ¾" and may comprise any suitable material, such as, for example, a rigid plastic material.

In some embodiments, one or both of the legs 4*a*, 4*b* comprise a tab 16. In some embodiments, the tab 16 is at a distal end of the leg 4*a*, 4*b*, or both. The tabs 16 are sized and configured to assist a user in installing the bracket 2 by, for example, allowing a user to flex the legs 4*a*, 4*b* outward to easily install the bracket 2 over a wall. The tabs 16 may comprise any suitable dimensions to allow a user to grip the tabs 16 to flex the legs 4*a*, 4*b*. For example, in one embodiment, the tabs 16 comprise a width of ¾" and a height of ½". In some embodiments, the tabs 16 are omitted and the legs 4*a*, 4*b* may be flexed outward by gripping the bottom edge of the legs 4*a*, 4*b*.

Figure 2:
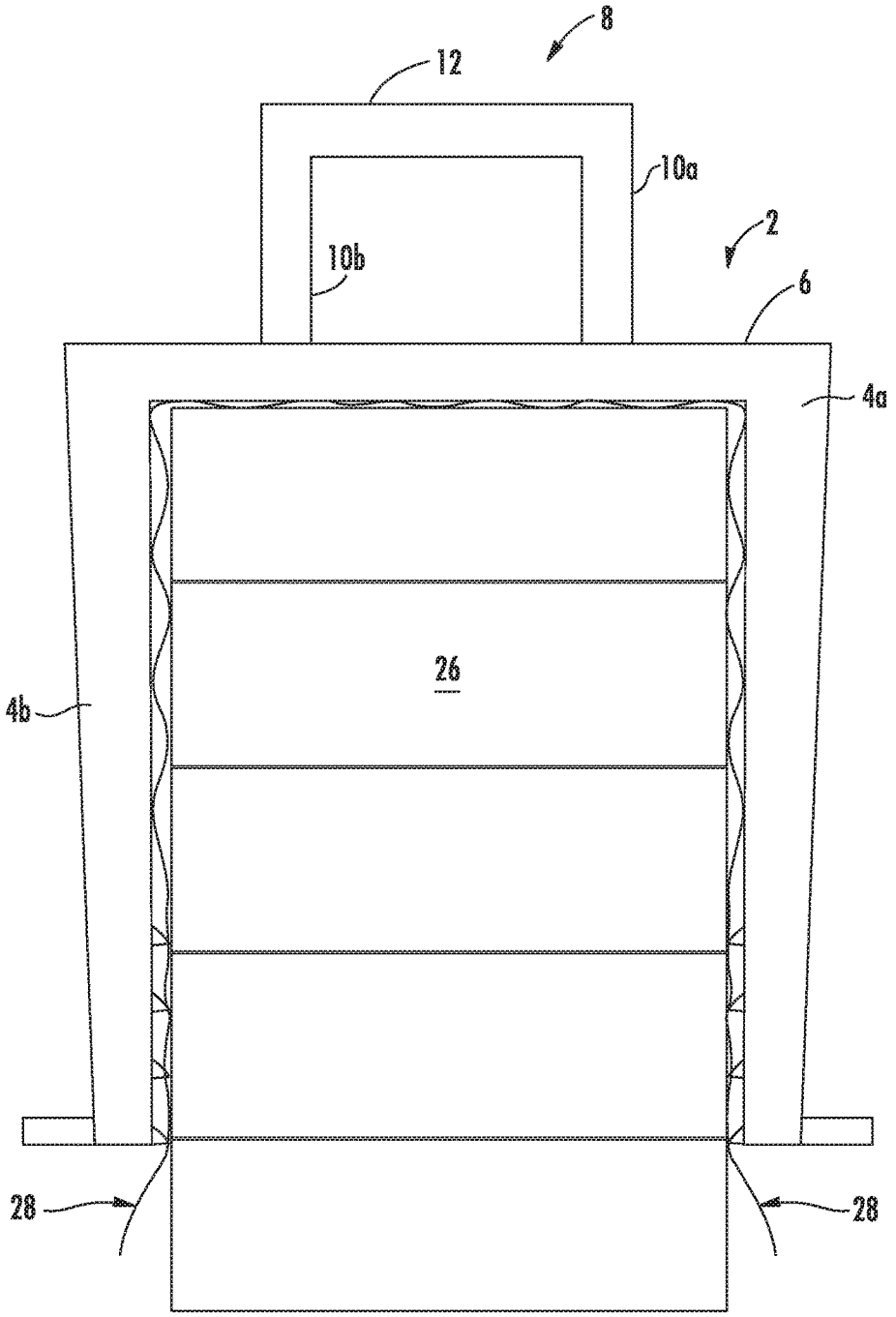
FIG. 2 illustrates one embodiment of the wall bracket of FIG. 1 placed over a wall.

FIG. 2 illustrates one embodiment of the bracket 2 coupled to a wall 26. The width 20 of the bracket 2 is selected such that the bracket 2 fits over the wall 26 with little to no gap between the legs 4*a*, 4*b* and the wall 26. A covering 28 is placed between the bracket 2 and the wall 26. The bracket 2 holds the covering 28 firmly in place over the wall 26 to protect the wall 26, for example, from environmental elements, such as, for example, moisture. As shown in FIG. 2, when the bracket 2 is installed on the wall 26, the legs 4*a*, 4*b* are forced into a substantially parallel alignment by the wall 26. In some embodiments, in the resting position, the legs 4*a*, 4*b* are biased so the bottom spacing 30 is smaller than the wall 26, resulting in the legs 4*a*, 4*b* gripping the wall 26 and applying pressure to the covering 28 and the wall 26 to securely anchor the covering 28 to the wall 26. The covering 28 may comprise any suitable wall covering, such as, for example, a plastic sheet, a tarp, and/or any other suitable covering. In some embodiments, the covering 28 comprises a 4 or 6 mil plastic sheet. The covering 28 may be cut from a larger roll/stock of plastic which is cut to the length of the wall 26.

Figure 3:
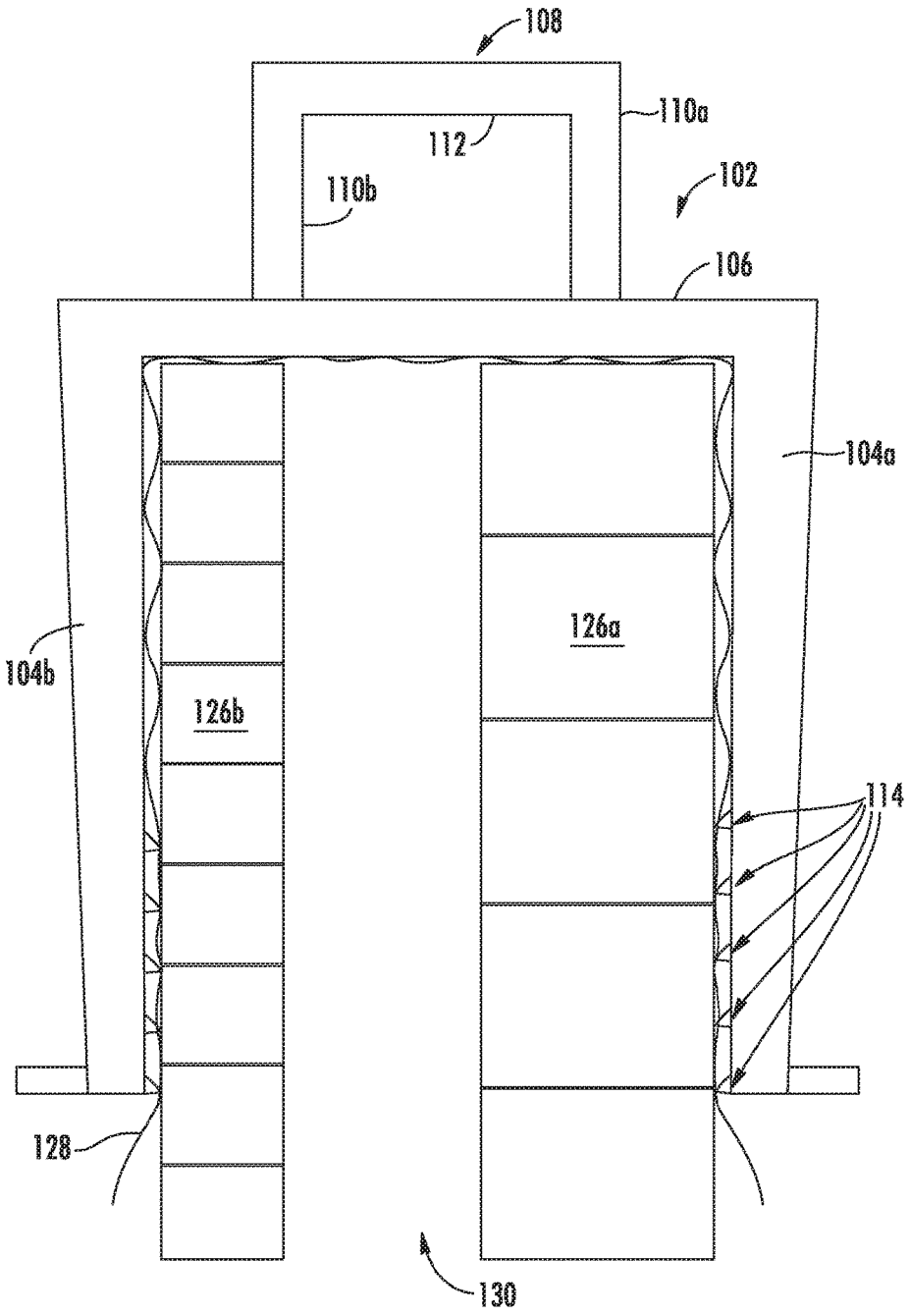
FIG. 3 illustrates a multi-width masonry wall having one embodiment of a wall bracket coupled thereto.

FIG. 3 illustrates a multi-width 126 wall having a bracket 102 coupled thereto. The multi-width wall 126 comprises a first wall section 126*a* and a second wall section 126*b*. The first and second wall sections 126*a*, 126*b* comprise varying thicknesses and equal heights. In some embodiments, the first wall section 126*a* comprises a structural wall and the second wall section 126*b* comprises a veneer wall. The structural wall 126*a* is separated from the veneer wall 126*b* by an air gap 130. A cover 128 is placed over the multi-width wall 126 to cover and protect the wall 126. The cross-member 106 of the bracket 102 comprises a sufficient length such that the bracket 102 may be placed over the first wall section 126*a*, the gap 130, and the second wall section 126*b* to hold the cover 128 in place.

FIG. 4 illustrates a multi-width wall 226 having a first bracket 202*a* and a second bracket 202*b* coupled thereto. The first bracket 202*a* is similar to the bracket 2 described with respect to FIGS. 1-2. The multi-width wall 226 comprises a first wall section 226*a* and a second wall section 226*b*. In some embodiments, the first wall section 226*a* comprises a structural wall section and the second wall section 226*b* a veneer wall section. The first wall section 226*a* comprises a first height and a first width and the second wall section 226*b* comprises a second height and a second width. The first bracket 202*a* is placed over the first wall section 226*a* to secure a first cover 228*a* thereto. The first bracket 202*a* comprises a width corresponding to the width of the first wall section 226*a*. As shown in the illustrated embodiment, the legs 204*a*, 204*b* of the first bracket 202*a* extend less than ½ of the height of the first wall section 226*a*, although it will be appreciated that the legs 4*a*, 4*b* may extend a length greater than or less than the length shown in the illustrated embodiment. The second bracket 202*b* is coupled to a second wall section 226*b* to secure a second cover 228*b* thereto. The second bracket 202*b* comprises a first leg 205*a* having a first length and a second leg 205*b* having a second length. The first leg 205*a* extends about half the height of the second wall section 226*b* to securely hold the second sheet 228*b* to the exposed face of the second wall section 226*b*. The second leg 205*b* comprises a length equal to about the height of one block 232 of the second wall section 226*b*. The shorter second leg 205*b* allows the second bracket 202*b* to be coupled to the second wall section 226*b* without risk of knocking protruding mortar located between the first wall section 226*a* and the second wall section 226*b* into the air gap 230.

Figure 5:
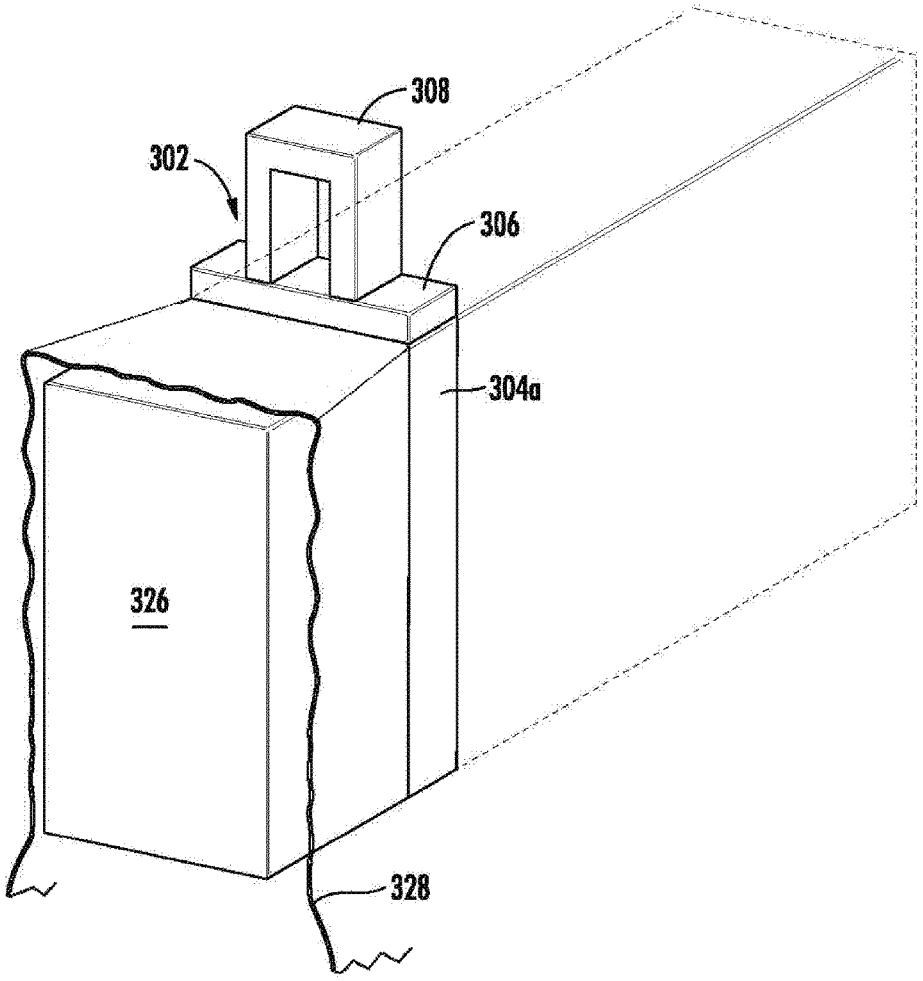
FIG. 5 illustrates a perspective view of a masonry wall having a wall bracket coupled thereto.
Figure 6:
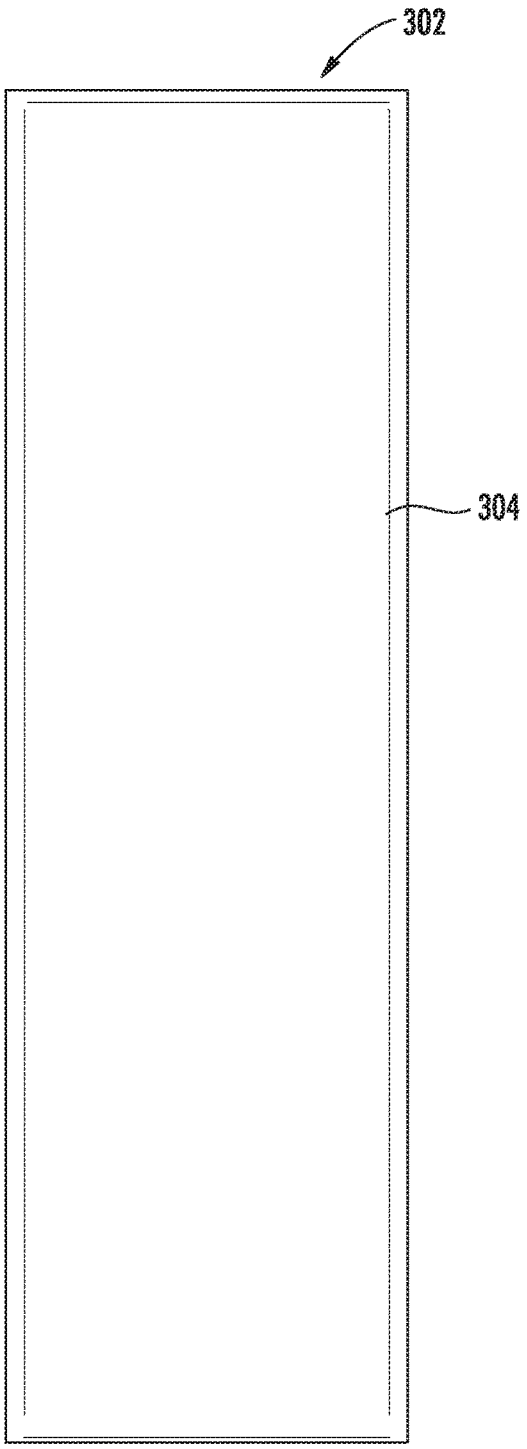
FIG. 6 is a side view of one embodiment of the wall bracket of FIG. 5.
Figure 9:
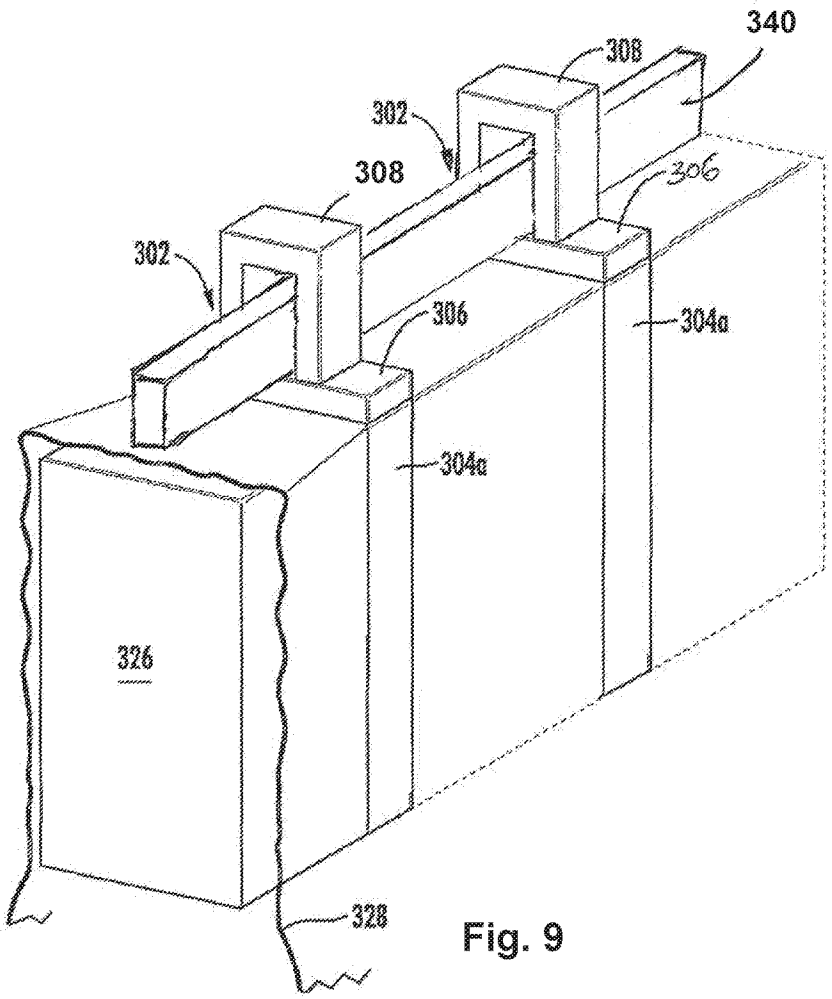
FIG. 9 illustrates a perspective view of two wall brackets secured together by an elongated support that are coupled to a masonry wall.

FIG. 5 illustrates one embodiment of a bracket 302 placed over a wall 326 to couple a cover 328 to the wall 326. The wall 326 comprises a predetermined height, thickness, and length. The bracket 302 is sized such that the space 32 between the first leg 304*a* and the second leg (not shown) at the cross-member 306 is equal to the width of the wall 326. A covering 328 extends over the wall and comprises a longitudinal length at least equal to the length of the wall 326. The bracket 302 is placed over the wall 326 and the covering 328 to securely couple the covering 328 to the wall 326. As shown in FIG. 9, multiple brackets 302 may be used to couple the covering 328 to the wall 326 depending on, for example, the longitudinal length of the wall 326. The handle 308 can include a handle opening and an elongated support 340 (e.g., a 2×4 stud) can be inserted through the handle openings 308 of the multiple brackets 302. In the illustrated embodiment, the bracket 302 comprises legs 304*a* having a width of about ¾". FIG. 6 illustrates a side view of the bracket 302.

Figure 7:
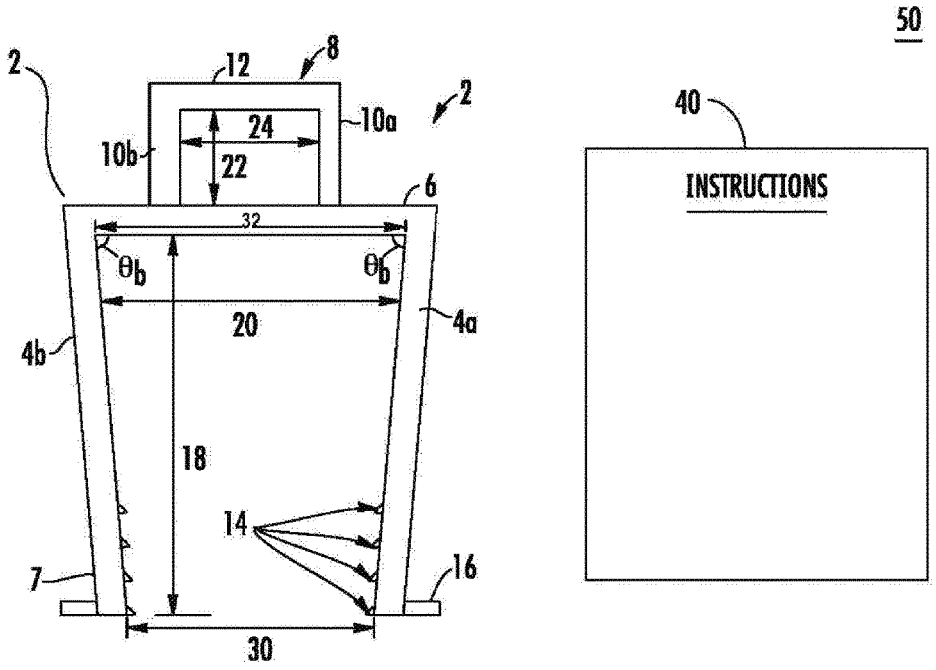
FIG. 7 illustrates a perspective view of a kit including a wall bracket and instructions.
Figure 8:
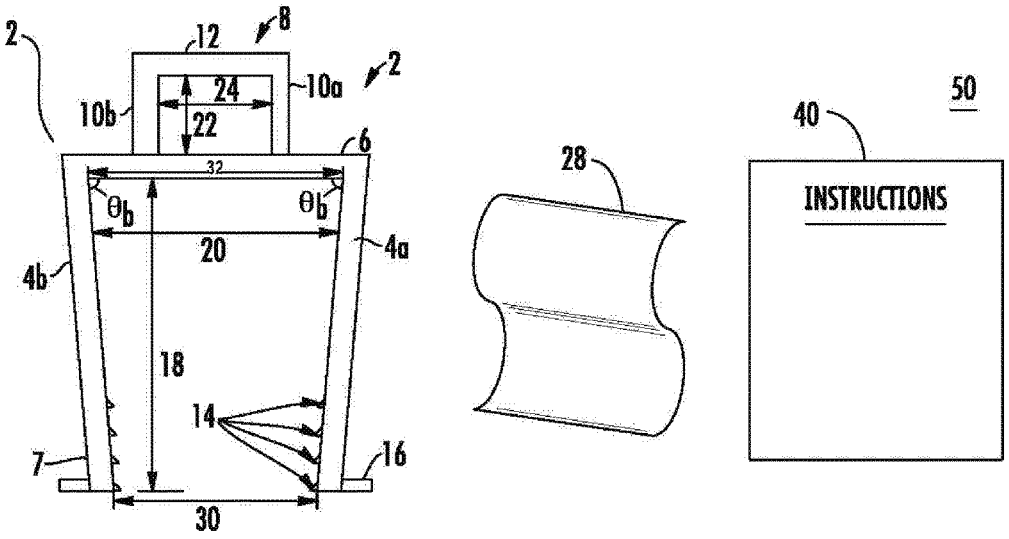
FIG. 8 illustrates a perspective view of a kit including a wall bracket, a cover and instructions.

In various embodiments, a kit 50 is disclosed. The kit 50 includes at least one bracket 2 as described herein, as well as instructions 40 for carrying out a method of using the bracket 2. FIG. 7 illustrates one embodiment of a kit 50 including a bracket 2 and instructions 40. In some embodiments, the kit 50 can include multiple brackets 2. For example, the kit 50 can include two brackets or more, three brackets or more, four brackets or more, 5 brackets or more, or 10 brackets or more. The brackets 2 can have varying sizes. For example, the brackets 2 can have different widths and/or different lengths. In some embodiments, at least two of the brackets have different sizes. In other embodiments, each of the brackets has a size. For example, a plurality or brackets 2 having different widths can be provided, and the widths can vary in increments of about 0.5 inch, 1 inch, 1.5 inches, 2 inches, 2.5 inches, or more. As shown in FIG. 8, the kit 50 can also include at least one covering 28.

Depending on the embodiment, the instructions 40 can be printed on one or more sheets (e.g., paper, polymer, poster), printed on packaging for the kit 50, or provided as text, images, video, and/or audio and video on a DVD, a web site or downloaded to a reader, smart phone, or other digital device. In some embodiments, the instructions 40 are directed toward using the bracket 2 to cover a wall 26 or otherwise prevent damage to the wall 26 from one or more environmental factors. The instructions 40 may include any of the method steps for using the bracket described herein. The instructions may also include one or more recommendations for selecting an appropriately-sized bracket. For example, selection of a bracket having a cross-member length/bracket width equal to or greater than a width of the wall to be covered and/or selection of a bracket having a leg length between about ¼ and ¾ of the height of the wall to be covered may be recommended.

The foregoing is provided for the purposes of illustrating, explaining, and describing embodiments of the present disclosure. Modifications and adaptations to these embodiments will be apparent to those skilled in the art and may be made without departing from the scope or spirit of this invention.

What is claimed is:

1. A method of covering a wall, comprising:

placing a covering over the wall, wherein the covering is configured to prevent damage to the wall from one or more environmental factors;

coupling the covering to the wall using a bracket, wherein the bracket is placed over the covering and the wall to hold the covering against the wall, the bracket comprising a first leg comprising at least one gripping feature extending from the inner surface of the first leg and a second leg coupled by a cross-member such that the bracket defines a U-shape, wherein a space between the first leg and the second leg at an open end of the U-shape is smaller than a space between the first and second legs at the cross-member, and wherein the length of the cross-member is equal to or greater than a width of the wall, the bracket further comprising a handle comprising a horizontal member, a first longitudinal member and a second longitudinal member each having a first end and a second end, the first end being coupled to the horizontal member and the second end coupled to the cross-member, wherein the first longitudinal member, the second longitudinal member, the horizontal member, and the cross-member form an enclosure surrounding a handle opening, the method further comprising inserting an elongated support through the handle opening.

2. The method of claim 1, wherein a one or both of the legs comprise a tab for flexing the legs outward.

3. The method of claim 1, wherein a width of the bracket ranges from ¾ inch to 23¾ inches.

4. The method of claim 1, wherein the first leg comprises a first length and the second leg comprises a second length different from the first length.

5. The method of claim 1, wherein the first leg and the second leg comprises a same length.

6. The method of claim 1, wherein an interior angle between the cross-member and the legs is less than 90°.

7. The method of claim 1, wherein one or both legs comprise a plastic material.

8. The method of claim 1, wherein the coupling step further comprises flexing one or both legs of the bracket outward before placing the bracket over the covering and the wall, then releasing the legs.

9. The method of claim 1, wherein the one or both of the legs of the bracket comprise a tab, and the coupling step further comprises using the tab to flex the legs outward.

10. The method of claim 1, wherein the wall is a masonry wall.

11. The method of claim 1, wherein the second leg comprises at least one gripping feature extending from an inner surface of the second leg.

12. The method of claim 1, wherein, when viewed from the side, each of the gripping features has a triangular cross-section.

13. The method of claim 1, wherein the first leg comprises a plurality of gripping features extending from the inner surface of the first leg, and the second leg comprises a plurality of gripping features extending from the inner surface of the second leg.

14. The method of claim 13, wherein there are the same number of gripping features of the first leg and the second leg and the gripping features on the first and second legs are arranged in opposing pairs, with each set of opposing pairs located an identical distance down the first leg and second leg from the cross-member.

15. The method of claim 13, wherein adjacent gripping features on each of the first leg and the second leg are spaced apart from one another along the first leg and the second leg, respectively.

16. The method of claim 1, wherein the bracket is a first bracket, the method further comprises:

coupling the covering to the wall using a secondary bracket, wherein the secondary bracket is placed over the covering and the wall to hold the covering against the wall at a location spaced apart from the first bracket, the secondary bracket comprising a first secondary bracket leg comprising at least one gripping feature extending from the inner surface of the first secondary bracket leg and a second secondary bracket leg coupled by a secondary bracket cross-member such that the secondary bracket defines a U-shape, wherein a space between the first secondary bracket leg and the second secondary bracket leg at an open end of the U-shape is smaller than a space between the first and second secondary bracket legs at the secondary bracket cross-member, and wherein a length of the secondary bracket cross-member is equal to or greater than a width of the wall, the secondary bracket further comprising a secondary bracket handle comprising a secondary bracket horizontal member, a first secondary bracket longitudinal member and a second secondary bracket longitudinal member each having a first end and a second end, the first end being coupled to the secondary bracket horizontal member and the second end coupled to the secondary bracket cross-member, wherein the first secondary bracket longitudinal member, the second secondary bracket longitudinal member, the secondary bracket horizontal member, and the secondary bracket cross-member form a secondary bracket enclosure surrounding a secondary bracket handle opening; and wherein the elongated support is inserted through both the handle opening and the secondary bracket handle opening to secure the first bracket and the secondary bracket together.

* * * * *